US006803932B2

(12) United States Patent
Itoh et al.

(10) Patent No.: US 6,803,932 B2
(45) Date of Patent: Oct. 12, 2004

(54) IMAGE FORMING APPARATUS

(75) Inventors: Isami Itoh, Shizuoka (JP); Takeshi Ikeda, Shizuoka (JP); Yukio Nagase, Shizuoka (JP); Nobuyuki Itoh, Shizuoka (JP); Yasukazu Ayaki, Kanagawa (JP); Tomohito Ishida, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/645,631

(22) Filed: Aug. 22, 2003

(65) Prior Publication Data

US 2004/0091292 A1 May 13, 2004

(30) Foreign Application Priority Data

Aug. 22, 2002 (JP) ..... 2002-241550
Aug. 20, 2003 (JP) ..... 2003-296721

(51) Int. Cl.[7] ..... B41J 2/385

(52) U.S. Cl. ..... 347/112; 430/42; 430/45; 430/363; 430/370; 430/952; 347/132; 358/520; 358/521; 358/534

(58) Field of Search ..... 347/132, 135, 347/130, 115, 117, 118; 430/42, 45, 54, 363, 370, 942, 945, 952; 358/520, 521, 534

(56) References Cited

U.S. PATENT DOCUMENTS 4,696,880 A * 9/1987 Shoji et al. ..... 430/42
4,700,261 A 10/1987 Nagase et al. ..... 361/225
4,721,662 A * 1/1988 Haneda ..... 430/42
4,756,985 A * 7/1988 Haneda et al. ..... 358/521
4,783,716 A 11/1988 Nagase et al. ..... 361/225
4,897,330 A * 1/1990 Shoji et al. ..... 430/54
RE33,633 E 7/1991 Hosono et al. ..... 361/213
5,255,014 A * 10/1993 Haneda et al. ..... 347/132
5,409,795 A * 4/1995 Kato ..... 430/115
5,698,354 A * 12/1997 Ugai et al. ..... 430/45
6,704,538 B2 * 3/2004 Nakamura et al. ..... 399/336

FOREIGN PATENT DOCUMENTS

| | | |
|---|---|---|
| JP | 5-313033 | 11/1993 |
| JP | 6-334272 | 12/1994 |
| JP | 7-321409 | 12/1995 |
| JP | 7-335975 | 12/1995 |
| JP | 8-88441 | 4/1996 |
| JP | 9-189930 | 7/1997 |
| JP | 9-275242 | 10/1997 |
| JP | 11-84764 | 3/1999 |
| JP | 2000-231279 | 8/2000 |
| JP | 2000-305339 | 11/2000 |
| JP | 2000-347476 | 12/2000 |
| JP | 2001-290319 | 10/2001 |
| JP | 2002-182456 | 6/2002 |

* cited by examiner

*Primary Examiner*—Eugene H. Eickholt
(74) *Attorney, Agent, or Firm*—Fitzpatrick, Cella, Harper & Scinto

(57) ABSTRACT

Provided is an image forming apparatus for forming a toner image including: a first light source emitting a beam corresponding to image information; a first photosensitive member; a first developing means for developing a latent image with a first toner; a second light source; a second photosensitive member; and a second developing means for developing a latent image with a second toner, in which the coloring agent contained in the first toner and the coloring agent contained in the second toner are substantially of the same hue, with the content of the coloring agent contained in the second toner being smaller than the content of the coloring agent contained in the first toner, and in which an oscillation wavelength of at least the first light source ranges from 370 to 500 nm. With the image forming apparatus structured as described above, an improvement in terms of granularity is achieved.

4 Claims, 6 Drawing Sheets

IMAGE FORMING APPARATUS

BACKGROUND OF THE INVENTION

1. Field of the Invention

The present invention relates to an image forming apparatus using an electrophotographic recording technique, such as a copying machine or a printer, and, in particular, to an image forming apparatus that performs image formation using at least two kinds of toner of substantially the same hue and different coloring agent contents.

2. Description of the Related Art

In recent years' electrophotographic image forming apparatuses, of which an image quality akin to that of silver salt photography is demanded, an improvement in terms of resolution and gradation is an issue that has become more important than ever.

Examples of a method of obtaining an image of high gradation include a dither method, a density pattern method, and a PWM method. Solid image areas, halftone image areas, and line areas are expressed by varying dot density, respectively.

However, it is difficult to place toner particles with high fidelity on dots formed by a laser beam corresponding to image information, and the toner particles may be deviated from the dots. Thus, such a problem is liable to occur that it is impossible to obtain, regarding a toner image, gradation reproducibility in correspondence with a dot density ratio of black and white areas of a digital latent image.

Further, in the case in which, to achieve an improvement in terms of image quality, an attempt is made to achieve an improvement in terms of resolution by diminishing a dot size, reproducibility for the latent image, formed of minute dots, suffers, making it rather difficult to stabilize the gradation reproducibility for a highlight image area.

Further, the irregular disturbance in the dots is perceived as granularity, which leads to deterioration in the image quality of the highlight image area.

To solve the above problems, there has been proposed a method, in which the highlight image area is formed by using light color toner, and in which the solid image area is formed by using deep color toner. For example, JP 11-84764 A and JP 2000-305339 A disclose an image forming method according to which image formation is effected by using a combination of a plurality of toners of different densties.

Further, JP2000-347476A discloses an image forming apparatus in which deep color toner is combined with light color toner whose maximum reflection density is not more than half the maximum reflection density of the deep color toner. JP 2000-231279 A discloses an image forming apparatus in which deep color toner exhibiting an image density of 1.0 or more is combined with light color toner exhibiting an image density of less than 1.0 when the amount of toner on the transfer material is 0.5 mg/cm$^2$. JP 2001-290319 A discloses an image forming apparatus in which deep color toner and light color toner whose recording density inclination ratio ranges from 0.2 to 0.5 are combined.

By thus developing the highlight image area by using light color toner, it is possible to achieve an improvement in terms of image quality of the highlight image area, which has been a problem in a high resolution digital full-color electrophotographic apparatus.

It is to be noted, however, that in the halftone image area, in which a deep-colored toner image is slightly superimposed on a light-colored toner image, when the dots formed by the deep color toner are large, the dots of the deep color toner become conspicuous, resulting in a deterioration in granularity. Further, owing to this deterioration in granularity, it is impossible to maintain smooth gradation corresponding to the image information, resulting in appearance of a noise such as a false contour.

SUMMARY OF THE INVENTION

The present invention has been made in view of the above problems in the prior art. It is an object of the present invention to provide an image forming apparatus capable of eliminating granularity from an output image.

Another object of the present invention is to provide an image forming apparatus superior in gradation characteristics.

Still another object of the present invention is to provide an image forming apparatus including:

- a first light source emitting a beam corresponding to image information;
- a first photosensitive means receiving the beam emitted from the first light source;
- a first developing means for developing a latent image formed on the first photosensitive member with a first toner;
- a second light source emitting a beam corresponding to image information;
- a second photosensitive member receiving the beam emitted from the second light source; and
- a second developing means for developing a latent image formed on the second photosensitive member with a second toner,
- in which a coloring agent contained in the first toner and a coloring agent contained in the second toner are substantially of the same hue, with the content of the coloring agent contained in the second toner being smaller than the content of the coloring agent contained in the first toner, and
- in which an oscillation wavelength of at least the first light source ranges from 370 to 500 nm.

Further objects of the present invention will become apparent from the following detailed description given with reference to the accompanying drawings.

BRIEF DESCRIPTION OF THE DRAWINGS

In the accompanying drawings:

FIG. 5 is a diagram illustrating an example of a color conversion method.

DESCRIPTION OF THE PREFERRED EMBODIMENTS

Preferred embodiments of this invention will now be described in detail with reference to the drawings. It is to be noted, however, that the sizes, materials, configurations, positional relationship, etc. of the components as given below should not be construed restrictively unless otherwise specified.

(First Embodiment)

An image forming apparatus according to a first embodiment of the present invention will be described with reference to FIG. 1, which is a schematic sectional view showing an image forming apparatus according to an embodiment of the present invention.

First, an image forming operation of the image forming apparatus of this embodiment will be schematically described.

Figure 1:
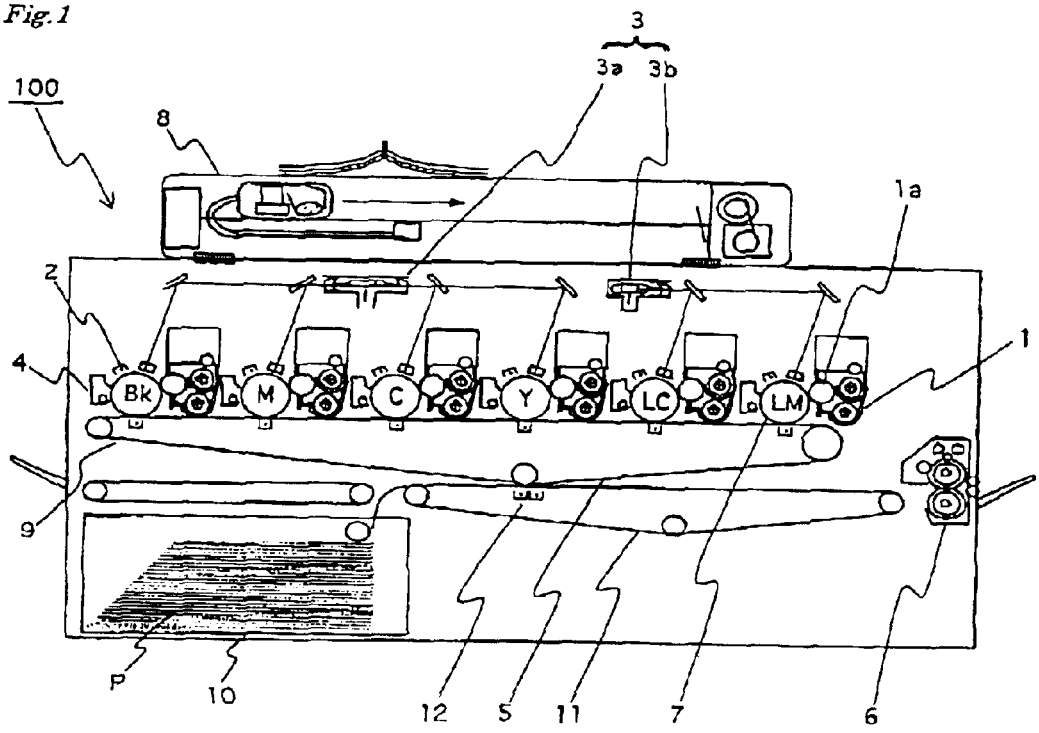
FIG. 1 is a sectional view of an image forming apparatus to which the present invention is applied.

As shown in FIG. 1, an image forming apparatus 100 of this embodiment has image forming units for six colors of cyan (C), magenta (M), yellow (Y), black (Bk), light cyan (LC), and light magenta (LM). Each image forming unit has a photosensitive member 7, a charging means 2 for charging the photosensitive member, a developing means 1 for developing an electrostatic latent image formed on the photosensitive member 7 with toner, a primary transfer means 9 for transferring a toner image formed on the photosensitive member 7 to an intermediate transfer belt 5, and a cleaning means 4 for removing toner remaining on the photosensitive member 7. Image reading apparatus 8 reads an image of an original. Each image forming unit forms a toner image as follows.

The surface of the photosensitive member 7 is uniformly charged by the charging means 2. The charged surface of the photosensitive member 7 is exposed by a laser exposure means 3 (3*a*, 3*b*) in correspondence with image information obtained by the image reading apparatus 8, or image information supplied from an outer terminal such as a personal computer, thereby forming an electrostatic latent image on the surface of the photosensitive member 7. The latent image thus formed is developed with toner by the developing means 1.

The toner image formed on the photosensitive member of each image forming unit is transferred to the intermediate transfer belt 5 by a primary transfer means 9. The toner images of different colors thus transferred are successively superimposed one upon the other as the intermediate transfer belt 5 runs, thereby forming a color image. At this time, residual toner remaining on each photosensitive member 7 without being transferred to the intermediate transfer belt 5 is removed from the surface of the photosensitive member 7 by the cleaning means 4.

The color image formed on the intermediate transfer belt 5 is transferred by a secondary transfer means 12 to a transfer material P, such as a paper sheet or OHP sheet, conveyed by a conveyor belt 11 from a sheet feeding cassette 10. The color image transferred to the transfer material P is fixed by a fixing means 6 before being output.

Next, each component will be described more specifically.

The photosensitive member 7 may be a multi-layer photosensitive member composed of a charge generating layer containing a charge generating material and a charge transporting layer stacked thereon and containing a charge transporting material, or a multi-layer photosensitive member composed of a charge transporting layer and a charge generating layer stacked thereon, or a single-layer photosensitive member in which a charge generating material and a charge transporting material are contained in a single layer, or a photosensitive member in which a protective layer is provided on the surface layer of such multi-layer or single-layer photosensitive member.

A support member for stacking the layers, such as the charge generating layer and the charge transporting layer, may be formed of a metal, such as iron, copper, gold, silver, aluminum, zinc, lead, tin, titanium, or nickel, an alloy thereof, an oxide of such metals, carbon, or molded conductive polymer. In some cases, a conductive coating is applied to or a conductive processing such as evaporation is performed on a non-conductive material, such as paper, plastic, or ceramic, so that the resultant product is used as the support member.

While in this embodiment the photosensitive member is in a drum-shaped configuration, which is cylindrical, columnar, or the like, it is also possible to adopt as appropriate a sheet-like or belt-like photosensitive member depending on use, layout, etc.

Further, it is also possible to further provide a conductive layer between the support member and the photosensitive layer, or to provide an intermediate layer in order to achieve an improvement in terms of intimacy with which the photosensitive layer is held in contact with the support member or the conductive layer or to achieve an improvement in electrical characteristics. The intermediate layer can be formed with casein, polyvinyl alcohol, nitrocellulose, polyvinyl butyral, polyester, polyurethane, gelatin, polyamide (nylon 6, nylon 66, nylon 610, copolymer nylon, alkoxymethylated nylon), aluminum oxide, and the like. A suitable film thickness of the intermediate layer is 0.1 to 10 $\mu$m and preferably 0.3 to 3.0 $\mu$m.

As the charge generating material, phthalocyanine pigment, polycyclic quinone pigment, trisazo pigment, disazo pigment, azo pigment, perylene pigment, indigo pigment, quinacridone pigment, azulenium salt dye, squarylium dye, cyanine dye, pyrylium dye, thiopyrylium dye, xanthene dye, triphenylmethane dye, styryl dye, selenium, selenium-tellurium alloy, amorphous silicon, cadmium sulfide, and the like can be suitably used.

Charge generating materials such as pigments and dyes are generally dispersed within a binder resin and used as a coating. As this type of binder resin, polyvinyl butyral, polyvinyl benzal, polyarylate, polycarbonate, polyester, polyurethane, phenoxy resin, acrylic resin, cellulose type resins, and the like are preferable.

As the charge transporting materials, pyrene compounds, N-alkylcarbazole compounds, hydrazone compounds, N,N-dialkylaniline compounds, diphenylamine compounds, triphenylamine compounds, triphenylmethane compounds, pyrazoline compounds, styryl compounds, stilbene compounds, polynitro compounds, polycyano compounds, and the like can be suitably used.

Charge transporting materials are generally dispersed within a binder resin and used as a coating. As the binder resin, polycarbonate, polyester, polyurethane, polysulfone, polyamide, polyarylate, polyacrylamide, polyvinyl butyral, phenoxy resin, acrylic resin, acrylonitrile resin, methacrylic resin, phenolic resin, epoxy resin, alkyd resin, and the like are preferable.

In this embodiment, a solution was prepared in which 10 parts by weight of polyamide (CM-8000, manufactured by Toray industries, Inc), 100 parts by weight of methanol, and 80 parts by weight of butanol are mixed and dissolved. Thereafter, the solution was applied to an aluminum cylinder subjected to surface treatment so as not to involve any interference fringes and having an outer diameter of 180 mm, a wall thickness of 1.5 mm, and a length of 363 mm by dip coating and dried. Thus, an intermediate layer having a thickness of 1.0 μm was obtained.

Next, 10 parts by weight of hydroxy gallium phthalocyanine pigment, 5 parts by weight of polyvinyl butyral resin (Esrec BX-S, manufactured by Sekisui Chemical Co., Ltd.), and 600 parts by weight of cyclohexanone were dispersed with a sand mill device using glass beads to obtain a charge generating layer coating material. This coating material was applied to the intermediate layer by ordinary dip coating and dried. Thus, a charge generating layer was obtained in an amount of 150 mg/cm$^2$.

Next, 10 parts by weight of triallyl amine compound and 10 parts by weight of polycarbonate resin (bisphenol Z type marketed under the trade name of Yuropin Z 200, manufactured by Mitsubishi Gas Chemical Company, Inc.) were dissolved in 50 parts by weight of monochlorobenzene and 20 parts by weight of methylal to obtain a charge transporting layer coating material. Then, the coating material was applied to the charge generating layer by dip coating and dried. Thus, a charge transporting layer having a thickness of 15 μm after drying was obtained.

Apart from the above compound, it is also possible to use an additive in the photoconductive layer constituting the charge generating layer in order to achieve an improvement in terms of mechanical characteristics and durability. Examples of the additive include antioxidant, ultraviolet absorbing agent, stabilizer, crosslinking agent, lubricant, and conductivity controlling agent.

The charging means 2 for primary charging may be a non-contact type using a coroner charger or a contact type using a roller charger.

Further, in the present invention, it is possible to provide a protective layer on the surface as needed.

The image forming unit has a developing device using a two-component developer containing toner and carriers. The toner used was a negatively charged toner prepared by polymerization and having a weighted mean grain size of 6 μm, and the carriers used were ferrite carriers having a weighted mean grain size of 35 μm.

The pigment densities (pigment (coloring agent) contents) of the deep color toner and the light color toner were adjusted such that the Macbeth reflection density is 1.8 when the amount of deep colortoner (M, C) on paper is 0.5 mg/cm$^2$ (in this embodiment, 3.5 parts of pigment for 100 parts of resin), whereas the Macbeth reflection density is 0.8 when the amount of light color toner (LM, LC) on paper is 0.5 mg/cm$^2$ (in this embodiment, 0.8 parts of pigment for 100 parts of resin).

The distance between the photosensitive member 7 and the developing sleeve 1*a* is preferably in the range of 100 to 500 μm. In this embodiment, the distance is 350 μm. The developing bias used was obtained by superimposing a DC component of −550 V on a rectangular-wave AC bias having a frequency of 2.0 kHz and amplitude of 2.0 kV.

The exposure means 3 of this embodiment has a semiconductor laser device (light source) for emitting a laser beam corresponding to image information, a polygon mirror for deflecting the laser beam emitted from this light source, a lens for effecting image formation on the photosensitive member with the laser beam deflected by the polygon mirror, etc.

The exposure means 3*a* provided with respect to the image forming units that form toner images using deep color toners (M, C, Y, and Bk) has four semiconductor laser devices and one polygon mirror for deflecting laser beams emitted from the four semiconductor laser devices. The oscillation wavelength of the four semiconductor laser devices ranges from 370 to 500 nm. In this embodiment, semiconductor laser devices of an oscillation wavelength of 405 nm are used.

The exposure means 3*b* provided with respect to the image forming units that form toner images using light color toners (LC and LM) has two semiconductor laser devices, and one polygon mirror for deflecting the laser beams emitted from the two semiconductor laser devices. The oscillation wavelength of the two semiconductor devices ranges from 650 to 800 nm. In this embodiment, semiconductor laser devices of an oscillation wavelength of 680 nm are used.

In this way, the image forming apparatus of this embodiment is equipped with two kinds of semiconductor laser devices: semiconductor laser devices whose oscillation wavelength ranges from 370 to 500 nm and semiconductor laser devices whose oscillation wavelength ranges from 650 to 800 nm.

Preferably, the charge generating layer material of all the six photosensitive members used in this embodiment exhibits a light absorption peak for each of the wavelengths of the two kinds of semiconductor laser devices. More specifically, hydroxy gallium phthalocyanine exhibits sufficient sensitivity to the wavelengths of the above two kinds of semiconductor laser devices. By using photosensitive members having such charge generating layers, there is no need to use a plurality of kinds of photosensitive members, thereby minimizing cost.

In this embodiment, corona chargers are used for the charging of the photosensitive members 7. The charging potential is set to −700 V, and the potential after exposure of solid image by the exposure means is set to −200 V.

As described above, in the image forming apparatus of the present invention, image formation is performed using at least a pair of deep color toner (e.g., cyan toner (first toner)) and light color toner (e.g., light cyan toner (second toner)) containing coloring agents of substantially the same hue in different contents.

How the toners are used in the image forming apparatus of this embodiment, forming images using deep color toner and light color toner of the same hue, will now be described as well as the operation of the apparatus.

Figure 2:
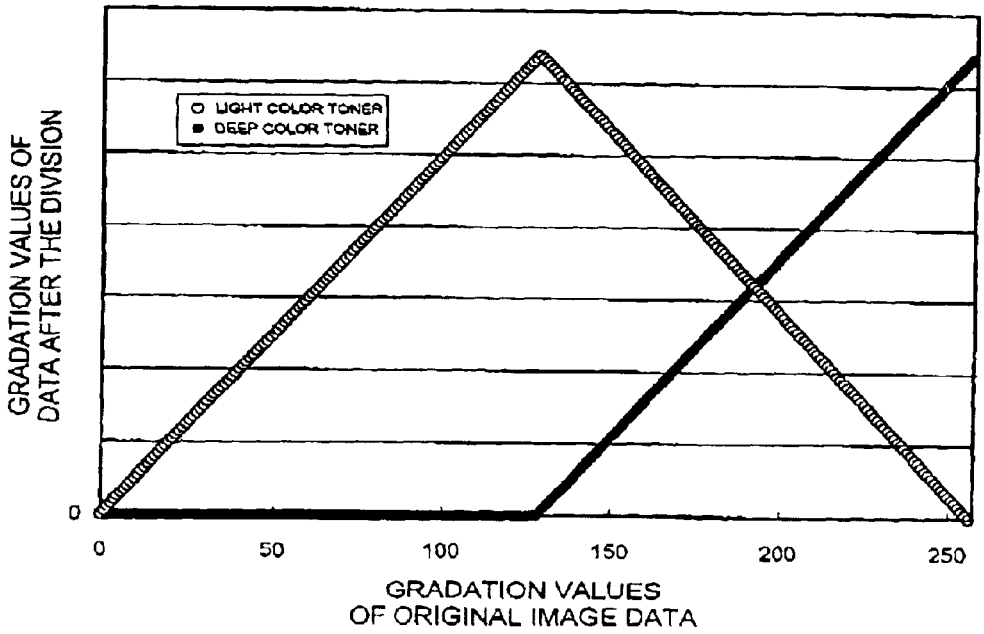
FIG. 2 is a gradation curve diagram in which the horizontal axis indicates gradation values of original image data before dividing the original image data into deep color toner image data and light color toner image data and in which the vertical axis indicates gradation values of data after the division into the deep color toner data and the light color toner data.

FIG. 2 shows an example of gradation curves of deep color toner and light color toner. The horizontal axis indicates image gradation value before division into deep color toner and light color toner, and the vertical axis indicates gradation values after division into deep color toner and light color toner. Here, the term "division" refers to dividing image data of a certain color (also referred to as plate or channel) into two pieces of image data for deep color toner and light color toner.

In the example shown in FIG. 2, in the high-lightness image area (highlight image area) where gradation value is small, image formation is performed solely with light color toner. Up to a gradation value of 128, the gradation of the light color toner is increased, and when the gradation value of 128 is exceeded, the gradation of the light color toner is reduced. Regarding the deep color toner, the gradation thereof is started to be increased when the gradation value of 128 is exceeded. That is, in the halftone image area, image formation is performed by using both the light color toner and deep color toner.

Figure 3:
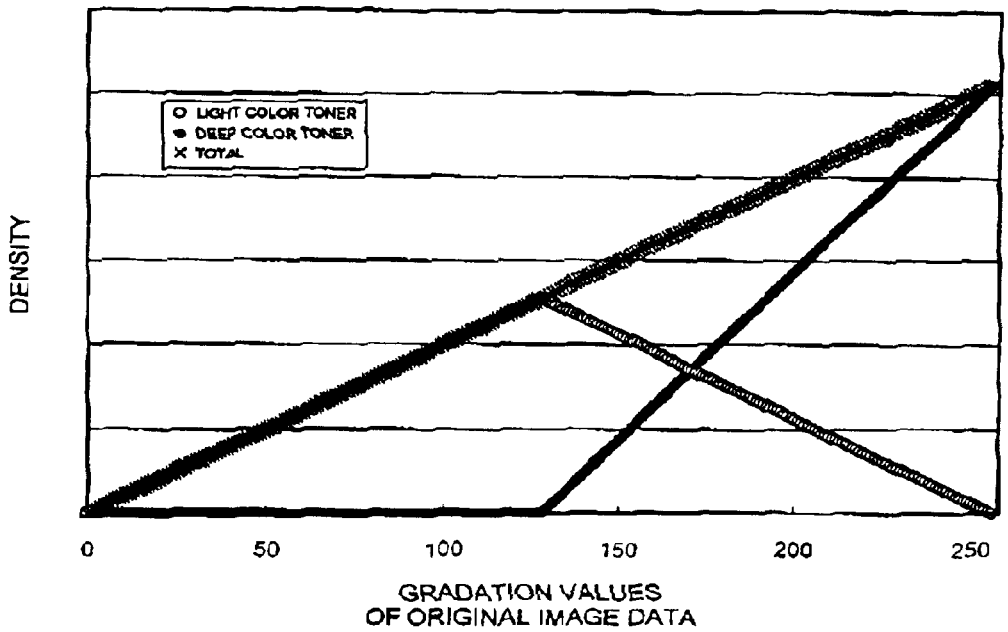
FIG. 3 is a diagram showing image density curves obtained from the gradation curves of FIG. 2.

The graph of FIG. 3 shows density curves of an image thus obtained. As in FIG. 2, the horizontal axis indicates the gradation value of the image, and the vertical axis indicates the density of the image. In the high-lightness image area, only the light color toner is used, and, in the halftone image area, both the deep color toner and light color toner are used, whereby a satisfactory gradation reproducibility is obtained.

Apart from the ones shown in FIG. 2, it is possible to adopt various gradation curves for the deep color toner and light color toner. To realize a satisfactory gradation reproducibility and a wide color reproduction area, it is preferable for the area where image formation is performed with both deep color toner and light color toner to be ⅕ or more of the entire gradation of the color concerned.

Figure 4:
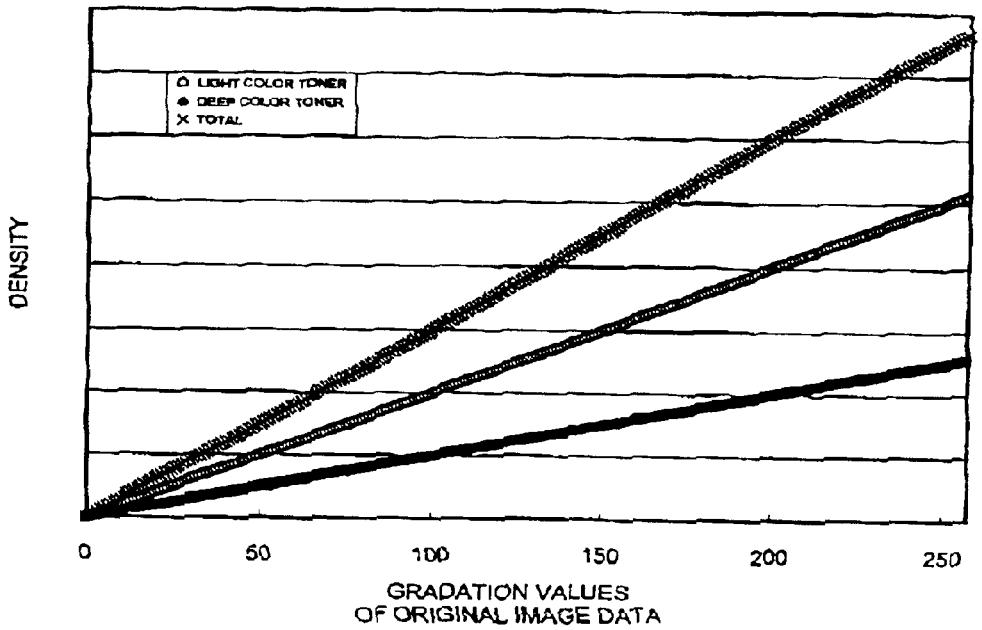
FIG. 4 is a diagram showing image density curves obtained from graduation curves different from those of FIG. 2.

However, as shown in FIG. 4, it is not preferable to use both the deep color toner and light color toner in the highlight image area since that would lead to deterioration in terms of granularity of the highlight image area (i.e., granularity of the toners being perceived). Thus, in the gradation range where the density of the image to be formed is 0.6 or less, it is preferable that only the light color toner be used, with no deep color toner being used.

Next, the image forming operation of the above-described image forming apparatus will be illustrated.

Here, a case will be described in which, based on an input image in three colors of red (R), green (G), and blue (B), image formation is performed by using six toners of cyan (DC), light cyan (LC), magenta (DM), light magenta (LM), yellow (Y), and black (K). That is, in outputting an image, two kinds of toner, LC and DC, are used for cyan, and two kinds of toner, LM and DM, are used for magenta.

In the image forming apparatus, a color image of an original is read by an original reading apparatus (scanner portion), and an input image signal color-separated into R, G, and B is obtained through a CCD. Alternatively, when the image forming apparatus has a printer function, print data in R, G, and B (input image signal) may be supplied from a computer. While in this example an input image in R, G, and B is used, this is only due to the specifications of the original reading apparatus and the printer driver of the computer.

When performing image formation, it is necessary to convert the input color signals RGB into color signals for image formation (i.e., allowing output through an output device) CMYK+LC+LM.

FIG. 5 shows an example of a color conversion system.

In FIG. 5, the RGB signals of the input image are color-separated into four colors of C, M, Y, and K, and then division into two pieces of plate data (deep and light) is effected for specific colors (C and M) to finally obtain color signals for six colors of Y, K, LC, DC, LM, and DM. Then, a predetermined γ correction is performed on the color signals of the six colors. Thereafter, halftone processing is performed on the signals before inputting them to the PWM circuit.

In this color conversion system, after conversion of the RGB color signals into primary colors of C, M, etc., separation into color signals for deep colors and light colors is effected as: LC+DC, and LM+DM. Thus, when there is a great difference in hue between the deep color and light color toners, nonuniformity in hue occurs in the monochrome gradation, highlight image areas, or the like, so that there is a fear of the obtained image being unnaturally perceived. In this embodiment, however, the two kinds of toner are substantially of the same hue, and more specifically, the hue variation is set at 30 degrees or less, and more preferably, 20 degrees or less, so that it is possible to realize a satisfactory gradation reproducibility and granularity and a wide color reproduction while restraining a deterioration in the quality of the output image.

Regarding the method of conversion into two pieces of plate data for deep color and light color, various toner combinations are possible depending on the toner density level, etc. FIG. 2 shows a basic linear gradation conversion method.

As shown in the drawing, in the highlight image area, the light color toner comes up first, and, as the halftone image area is approached, the deep color toner starts to come in. Gradation is reproduced through a combination of the deep color toner and light color toner for a while. Then, in the high image density area, the use of the light color toner is gradually restricted. The combination of the deep color toner and light color toner at this time is determined by the relationship between the image qualities concerning granularity, gradation and color area, and the toner consumption. Further, while in this example a linear gradation is shown for the sake of convenience, in actuality, it is preferable to draw a gentle curve at the start of introduction of each of the deep color toner and light color toner from the viewpoint of preventing tone jump.

Figure 6:
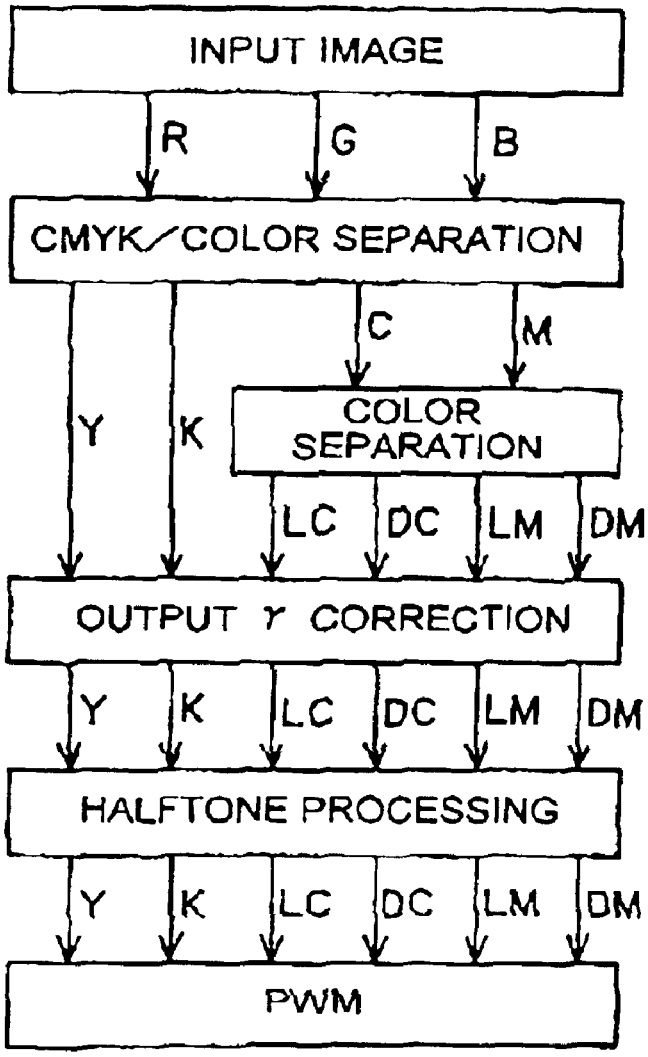
FIG. 6 is a diagram illustrating another example of the color conversion method (direct mapping).
Figure 6:
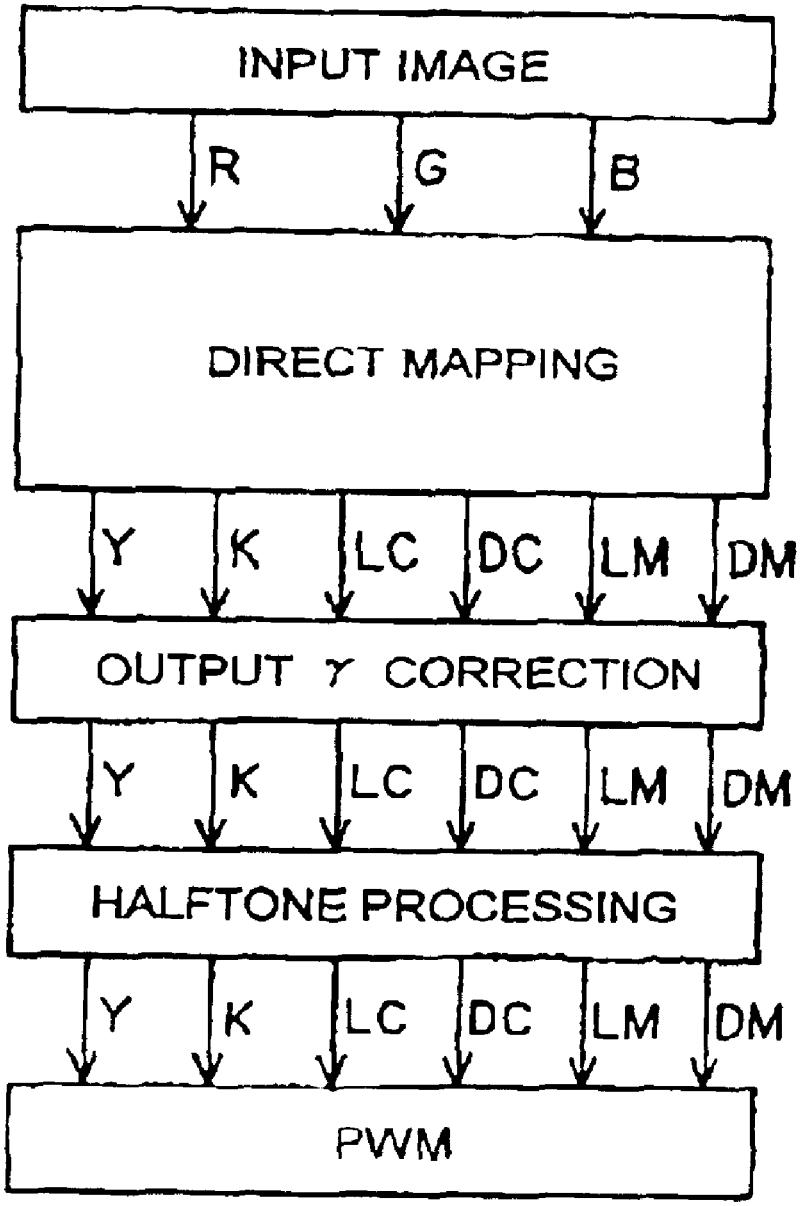

FIG. 6 shows another color conversion system.

In this case, from RGB input signals of an input image, color separation into signals for six colors, Y, K, LC, DC, LM, and DM is directly effected through direct mapping.

Direct mapping is a color conversion system in which conversion from an input signal (color information of an input image) to an output signal (color information for image formation) of an output device is directly effected with reference to a look-up table (LUT). For example, by providing three input signals of RBG or the like, the signal value for the output color space necessary for the reproduction of that color is output in the form of four colors of CMYK or six colors of CMYK+LC+LM.

This color conversion system requires no matrix computation, and makes it possible to effect non-linear conversion, whereby a substantial improvement is achieved in terms of degree of freedom for color conversion such as setting of UCR (Under Color Removal). Thus, it is possible to effect a desired color reproduction while controlling the amount of toner placed.

Further, indirect mapping, color signals for deep color toner and light color toner are directly generated from the RGB signals of the input image, so that there is no fear of deterioration in output quality due to a difference in hue between the deep color toner and light color toner, which might be entailed in the method of FIG. 5.

As described above, in the image forming apparatus of this embodiment, deep color toner and light color toner of different densities and hues are used. In the high-lightness image area, image formation is performed using the light color toner alone, and in the halftone image area, image formation is performed using both the light color toner and deep color toner, so that it is possible to realize a satisfactory gradation reproducibility and granularity. In particular, it is possible to realize a wide color reproduction range from the halftone image area to the high-lightness image area, which is of importance when outputting a natural image or the like, making it possible to form an image of high quality.

However, as stated above, in a gradation in which a slight amount of deep color toner is mixed in an image formed of light color toner alone, when the deep color toner has a large dot size, granularity of the image deteriorates to degrade the image quality.

In view of this, in the present invention, at least the oscillation wavelength of the light source (first light source) for applying a beam corresponding to image information to the photosensitive member (first photosensitive member) bearing the deep color toner (first toner) image is set at 370 to 500 nm. In this embodiment, a semiconductor laser device having an oscillation wavelength of 405 nm is used, whereby it is possible to minimize a dot size of the electrostatic latent image formed on the photosensitive member by using the light source for the deep color toner, and even in the case of a gradation in which a slight amount of deep color toner is mixed in an image formed with the light color toner alone, the deep color toner is inconspicuous, making it possible to prevent granularity appearing in the image.

A semiconductor laser device having an oscillation wavelength ranging from 370 to 500 nm is rather expensive. In this embodiment, however, the semiconductor laser device of the exposure means 3*b* on the image forming unit side forming a light color toner image is one whose oscillation wavelength ranges from 650 to 800 nm, i.e., a semiconductor laser device that is relatively inexpensive. By thus using two kinds of semiconductor laser devices, it is advantageously possible to minimize the cost of the apparatus as a whole.

COMPARATIVE EXAMPLE

In a comparative example, a semiconductor laser device whose oscillation wavelength ranges from 650 to 800 nm is used for the exposure means 3*a* on the image forming unit side forming a deep color image. Otherwise, the comparative example is the same as the first embodiment (the oscillation wavelength of the semiconductor laser device used in this comparative example is 680 nm).

Table 1 shows subjective evaluation results on the granularity of images having a density ranging from 0.6 to 0.8, at which deep color toner is started to be used for image formation in the image forming apparatus of this embodiment and that of the Comparative Example. The evaluation was made in four levels: >○>Δ>x Symbol indicates an image with a gradation reproducibility that is so smooth that the observer perceives practically no granularity in the image.

TABLE 1

| | D = 0.6 | D = 0.7 | D = 0.8 |
|---|---|---|---|
| First Embodiment | ◎ | ○ | ○ |
| Comparative Example | Δ | x | Δ |

As is apparent from the results shown in Table 1, in the image forming apparatus of the first embodiment, a semiconductor laser device with a small oscillation wavelength is used for latent image formation on the photosensitive member for development of a deep color toner image, and a semiconductor laser device with a large oscillation wavelength is used for latent image formation on the photosensitive member for development of a light color toner image. Unlike the case in which, as in the comparative example, a semiconductor laser device with a large oscillation wavelength is used for the exposure means for both the deep color toner and the light color toner, the construction of this embodiment involves no granularity in the image from the image density area where only the light color toner is used to the image density area where deep color toner is started to be used, thus achieving a substantial improvement in terms of granularity. Further, since the number of semiconductor laser devices with small oscillation wavelength used is suppressed, it is possible to minimize the apparatus cost.

As described above, the semiconductor laser device with a small oscillation wavelength is used at least for latent image formation on the photosensitive member for development of the deep color toner image, and the semiconductor laser device with a large oscillation wavelength is used for latent image formation on the photosensitive member for development of the light color toner image, whereby it is possible to achieve a substantial improvement in terms of granularity in the image density area where switching is effected from the image density area where only the light color toner is used to the image density area where the deep color toner is started to be used.

(Second Embodiment)

An apparatus of a second embodiment is the same as that of the first embodiment except that all the semiconductor laser devices used have an oscillation wavelength ranging from 370 to 500 nm. In this embodiment, all the semiconductor laser devices used have an oscillation wavelength of 405 nm.

Table 2 shows subjective evaluation results on the granularity of images having a density ranging from 0.6 to 0.8, at which deep color toner is started to be used for image formation in the image forming apparatus of this embodiment and that of the above-mentioned Comparative Example. The evaluation was made in four levels: >○>Δ>x.

TABLE 2

| | D = 0.6 | D = 0.7 | D = 0.8 |
|---|---|---|---|
| Second Embodiment | ◎ | ◎ | ◎ |
| Comparative Example | Δ | x | Δ |

By thus using the semiconductor laser devices with a small oscillation wavelength for all the exposure means, an improvement in granularity superior to that in the first embodiment was obtained.

The above embodiments of the present invention should not be construed restrictively, and various modifications are possible without departing from the gist of the invention.

What is claimed is:

1. An image forming apparatus for forming a toner image on a recording material, comprising:

a first light source emitting a beam corresponding to image information;

a first photosensitive member receiving the beam emitted from said first light source;

a first developing means developing a latent image formed on said first photosensitive member with a first toner;

a second light source emitting a beam corresponding to image information;

a second photosensitive member receiving the beam emitted from said second light source; and a second developing means for developing a latent image formed on said second photosensitive member with a second toner, wherein a coloring agent contained in the first toner and a coloring agent contained in the second toner are substantially of the same hue, with the content of the coloring agent contained in the second toner being smaller than the content of the coloring agent contained in the first toner, and wherein an oscillation wavelength of at least said first light source ranges from 370 to 500 nm.

2. An image forming apparatus according to claim 1, wherein an oscillation wavelength of said second light source is longer than the oscillation wavelength of said first light source.

3. An image forming apparatus according to claim 2, wherein oscillation wavelength of said second light source ranges from to 800 nm.

4. An image forming apparatus according to claim 1, wherein apparatus forms a toner image using solely the second toner high-lightness image area, and, forms a toner image using the first toner and the second toner in a halftone image area.

* * * * *

UNITED STATES PATENT AND TRADEMARK OFFICE

CERTIFICATE OF CORRECTION

PATENT NO. : 6,803,932 B2
DATED : October 12, 2004
INVENTOR(S) : Isami Itoh et al.

It is certified that error appears in the above-identified patent and that said Letters Patent is hereby corrected as shown below:

Column 2,
Line 18, “apparatus” should read -- apparatus, --.

Column 5,
Line 43, “colortoner” should read -- color toner --.

Column 8,
Line 36, “indirect” should read -- in direct --.

Column 9,
Line 28, “>o>Δ>x Symbol” should read -- ◎>o>Δ>x. Symbol ◎ --.

Column 10,
Line 13, “>o>Δ>x.” should read -- ◎>o>Δ>x. --.
Line 59, “wherein” should read -- wherein the --.
Line 60, “from” should read -- from 650 --.
Line 62, “wherein” should read -- wherein said --.
Line 63, “second toner” should read -- second toner in a --.
Line 64, “using” should read -- using both --.

Signed and Sealed this

Twenty-ninth Day of March, 2005

JON W. DUDAS
*Director of the United States Patent and Trademark Office*